United States Patent [19]

Dörr et al.

[11] Patent Number: 5,030,415

[45] Date of Patent: Jul. 9, 1991

[54] STRUCTURAL PART MADE OF FERRITIC CHROMIUM-MOLYBDENUM STEEL WHICH IS RESISTANT TO CONCENTRATED SULFURIC ACID

[75] Inventors: Karl-Heinz Dörr, Mainz; Hermann Müller, Kulmbach; Ulrich Sander, Friedrichsdorf; Wolfram Schalk, Neu-Anspach; Ernst Wallis, Eschborn, all of Fed. Rep. of Germany

[73] Assignee: Metallegesellschaft Aktiengesellschaft, Frankfurt am Main, Fed. Rep. of Germany

[21] Appl. No.: 398,114

[22] Filed: Aug. 24, 1989

[30] Foreign Application Priority Data

Sep. 7, 1988 [DE] Fed. Rep. of Germany ..... 3830365

[51] Int. Cl.[5] ..... C22C 38/44

[52] U.S. Cl. ..... 420/68; 420/69

[58] Field of Search ..... 420/68, 69; 148/325

[56] References Cited

FOREIGN PATENT DOCUMENTS 2124391 12/1971 Fed. Rep. of Germany ..... 420/68

*Primary Examiner*—Deborah Yee

*Attorney, Agent, or Firm*—Sprung Horn Kramer & Woods

[57] ABSTRACT

Ferritic chromium-molybdenum steels containing 26 to 30% chromium
1.8 to 3.0% molybdenum
3.0 to 4.5% nickel
carbon $\leqq$ 0.02%
silicon $\leqq$ 1.00%
manganese $\leqq$ 1.00%
sulfur $\leqq$ 0.015%
carbon + nitrogen $\leqq$ 0.045%
niobium $\geqq 12 \times \%C \leqq 1.2\%$
balance iron and impurities which are due to the melting technology are used as corrosion-resisting material to make structural parts which are resistant to sulfuric acid in a concentration of and above 94% by weight and at a temperature up to the boiling point of the sulfuric acid.

2 Claims, No Drawings

STRUCTURAL PART MADE OF FERRITIC CHROMIUM-MOLYBDENUM STEEL WHICH IS RESISTANT TO CONCENTRATED SULFURIC ACID

BACKGROUND OF THE INVENTION

This invention relates to the use of a ferritic chromium-molybdenum steel having a high resistance to the corrosion by concentrated sulfuric acid.

Sulfuric acid is usually produced by a catalytic reaction of the $SO_2$ content of gases to form $SO_3$ and—if the gases are dry—a subsequent absorption of the resulting $SO_3$ in concentrated sulfuric acid or—if the gases are moist—a subsequent condensation of the resulting sulfuric acid.

In such processes, dryers, absorbers, heat exchangers, receivers associated with pumps, piping etc. are contacted with concentrated sulfuric acid having a concentration of or above 94% by weight. That sulfuric acid is an extremely aggressive fluid, which tends to subject the structural parts employed to a rapid and strong corrosion. For this reason all structural parts contacted by that sulfuric acid must consist of corrosion-resisting materials. Materials used for that purpose consist of special alloy steels, cast iron, plastics, ceramics, glass, graphite or of linings made of such materials. But the non-metallic materials have only a low mechanical strength and their processing is difficult for numerous applications. Whereas the metallic materials have a high mechanical strength, their resistance to corrosion is not sufficient in some cases or the material can be deformed only with difficulty or the material is highly expensive.

DE-C 21 54 126 discloses the use of an austenitic nickel alloy, which contains chromium, molybdenum, cobalt, manganese, copper and silicon for acids in a concentration of and above 65%. Because that alloy can be deformed only with difficulty, it can be used only for shafts, bearings, pumps, valve parts and the like elements.

DE-A-33 20 527 discloses the use of austenitic steels which contain 4.6 to 5.8% silicon. But it is difficult to process and make that material.

EP-B-0 130 967 describes four materials for use in sulfuric acids of 98 to 101% and at a temperature in excess of 120° C. The highest resistance to corrosion has the ferritic material Alloy 26–1 (Material No. 1.4131, XlCrMo261), which contains up to 0.5% nickel. But that material can be processed only with difficulty and its resistance to corrosion strongly decreases as the concentration of the sulfuric acid decreases.

In EP-A-0 181 313 the ferritic material 29-4-2 has been mentioned as the second-best material, after the Alloy 26–1. for use in sulfuric acid of 98–101%. That material contains 28–30% Cr, 3.50–4.20% Mo and 2.00–2.50% Ni. That material can also be processed only with difficulty and its resistance to corrosion strongly decreases as the concentration of sulfuric acid decreases.

EP-B-0 200 862 discloses the use of a molybdenum-free alloy, which contains chromium, for use in sulfuric acid above 96% and at temperatures up to 350° C. It is not significant whether the alloy has a ferritic or a ferritic-austenitic or austenitic structure. Particularly if the material has an austenitic or austenitic-ferritic structure and is used in sulfuric acids having a lower concentration that material does not have an adequate resistance to corrosion.

SUMMARY OF THE INVENTION

It is an object of the invention to provide a material which has a high resistance to corrosion in sulfuric acid even at a relatively low concentration and which has good working properties, i.e., good processing properties and can be made at low cost.

In accordance with the invention that object is accomplished by the use of ferritic chromium-molybdenum steels containing 26 to 30% chromium
1.8 to 3.0% molybdenum
3.0 to 4.5% nickel
carbon $\leqq$ 0.02%
silicon $\leqq$ 1.00%
manganese $\leqq$ 1.00%
sulfur $\leqq$ 0.015%
carbon + nitrogen $\leqq$ 0.045%
niobium $\geqq$ 12 × %C $\leqq$ 1.2%
balance iron and impurities which are due to the melting technology as a corrosion-resisting material to make structural parts which are resistant to sulfuric acid in a concentration of and above 94% by weight and at a temperature up to the boiling point of the sulfuric acid.

Impurities which are due to the melting technology may consist, e.g., of phosphorus, aluminum, vanadium, titanium, tantalum, calcium, magnesium, cerium, boron.

The total content of such impurities should not exceed 1%. The material has good deformation properties and is highly suitable for the manufacture of structural parts from sheet metal elements or strip, such as heat exchangers, piping, receivers associated with pumps, sprinkling systems, absorbers etc. The material will resist a corrosion also by cold sulfuric acid.

DETAILED DESCRIPTION OF THE INVENTION

A preferred embodiment consists in the use of a ferritic chromium-molybdenum steel containing 27 to 29% chromium
2.0 to 3.0% molybdenum
3.0 to 4.5% nickel
carbon $\leqq$ 0.02%
carbon + nitrogen $\leqq$ 0.045%
(niobium + zirconium) $\geqq$ 10 × % (carbon + nitrogen)
balance iron and impurities which are due to the melting technology as a corrosion-resisting material to make structural parts which are resistant to sulfuric acid in a concentration of and above 94% by weight and at a temperature up to the boiling point of the sulfuric acid.

Table I indicates the behavior of the material in accordance with the invention under corrosive conditions at various temperatures and concentrations of sulfuric acid.

The corrosion resistance was determined by immersion tests. In all cases, the test was conducted for 25 days. The rates of material removal were determined by a gravimetric weighing to determine the difference and conversion to mm/y. The testing fluid was renewed after each testing cycle.

The material contained 28% Cr, 2% Mo and 4% Ni.

TABLE I

| Concentration | Temperature | Designation of samples | Days of test | Rate of removal of material g/m² h | Rate of removal of material linear mm/y |
|---|---|---|---|---|---|
| 98.5% | 150° C. | 1 | 7 | 0.01 | 0.01 |
| | | | 18 | 0.01 | 0.01 |
| | | | 25 | <0.01 | <0.01 |
| | | 2 | 7 | 0.01 | 0.01 |
| | | | 18 | 0.01 | 0.01 |
| | | | 25 | 0.01 | 0.01 |
| 99.0% | 150° C. | 3 | 7 | 0.01 | 0.01 |
| | | | 18 | <0.01 | <0.01 |
| | | | 25 | <0.01 | <0.01 |
| | | 4 | 7 | 0.01 | 0.01 |
| | | | 18 | 0.01 | 0.01 |
| | | | 25 | <0.01 | <0.01 |
| 99.5% | 150° C. | 5 | 7 | <0.01 | <0.01 |
| | | | 18 | <0.01 | <0.01 |
| | | | 15 | <0.01 | <0.01 |
| | | 6 | 7 | <0.01 | <0.01 |
| | | | 18 | <0.01 | <0.01 |
| | | | 25 | <0.01 | <0.01 |
| 98.5% | 175° C. | 7 | 7 | 0.02 | 0.02 |
| | | | 18 | 0.01 | 0.01 |
| | | | 25 | 0.01 | 0.01 |
| | | 8 | 7 | 0.02 | 0.02 |
| | | | 18 | 0.01 | 0.01 |
| | | | 25 | 0.01 | 0.01 |
| 99.0% | 175° C. | 9 | 7 | 0.02 | 0.02 |
| | | | 18 | 0.01 | 0.01 |
| | | | 25 | 0.01 | 0.01 |
| | | 10 | 7 | 0.01 | 0.02 |
| | | | 18 | 0.01 | 0.01 |
| | | | 25 | 0.01 | 0.01 |
| 99.5% | 175° C. | 11 | 7 | <0.01 | <0.01 |
| | | | 18 | <0.01 | <0.01 |
| | | | 25 | <0.01 | <0.01 |
| | | 12 | 7 | <0.01 | <0.01 |
| | | | 18 | <0.01 | <0.01 |
| | | | 25 | <0.01 | <0.01 |
| 98.5% | 200° C. | 13 | 7 | 0.03 | 0.04 |
| | | | 18 | 0.02 | 0.02 |
| | | | 25 | 0.02 | 0.02 |
| | | 14 | 7 | 0.03 | 0.03 |
| | | | 18 | 0.02 | 0.02 |
| | | | 25 | 0.02 | 0.02 |
| 99.0% | 200° C. | 15 | 7 | 0.02 | 0.03 |
| | | | 18 | 0.02 | 0.02 |
| | | | 25 | 0.02 | 0.02 |
| | | 16 | 7 | 0.02 | 0.03 |
| | | | 18 | 0.02 | 0.02 |
| | | | 25 | 0.02 | 0.02 |
| 99.5 | 200° C. | 17 | 7 | 0.01 | 0.01 |
| | | | 18 | 0.01 | 0.01 |
| | | | 25 | <0.01 | <0.01 |
| | | 18 | 7 | 0.01 | 0.01 |
| | | | 18 | 0.01 | 0.01 |
| | | | 25 | <0.01 | <0.01 |

In sulfuric acid having a concentration of 95% by weight, the rates of material removal amounted to 0.06 mm/y at 100° C.

0.05 mm/y at 125° C.

0.32 mm/y at 150° C.

The advantages afforded by the use of the material in accordance with the invention reside in that the stated range of the molybdenum content the tendency of brittle intermetallic phases to precipitate is relatively low. The nickel content will relatively strongly decrease the rate of precipitation and in a thermodynamic equilibrium will narrow the heterogeneous fields. The combination of these two effects results in a higher stability of the structure during welding and heat-treating processes. As a result, there is a high resistance to corrosion and a high ductility as is exhibited by the high notched-bar impact strength. The material can be welded in thicknesses up to 50 mm. The material 29-4-2 can be welded only up to about 2 mm.

It is apparent that the material in accordance with the invention has a very good processibility in conjunction with a very high resistance to corrosion.

What is claimed is:

1. A sulfuric acid resistant structural part made of ferritic chromium-molybdenum steels containing 26 to 30% chromium
1.8 to 3.0% molybdenum
3.0 to 4.5% nickel
carbon $\leqq$ 0.02%
silicon $\leqq$ 1.00%
manganese $\leqq$ 1.00%
sulfur $\leqq$ 0.015%
carbon + nitrogen $\leqq$ 0.045%
12 × %C $\leqq$ niobium $\leqq$ 1.2%
balance iron and impurities which are due to the melting technology which is resistant to sulfuric acid in a concentration of and above 94% by weight and at a temperature up to the boiling point of the sulfuric acid.

2. The part made of ferritic chromium-molybdenum steels according to claim 1 containing 27 to 29% chromium
2.0 to 3.0% molybdenum
3.0 to 4.5% nickel
carbon $\leqq$ 0.02%
carbon + nitrogen $\leqq$ 0.045%
1.2% $\geqq$ (niobium + zirconium) $\geqq$ 10 × % (carbon + nitrogen)
balance iron and impurities which are due to the melting technology.

* * * * *